United States Patent [19]

Barnes

[11] 4,036,442

[45] July 19, 1977

[54] LOW FRICTION MEAT EXTRUDER AND CUTTER MEANS THEREFOR

[75] Inventor: J. Haywood Barnes, Wadsworth, Ohio

[73] Assignees: Edwin W. Oldham; Vern L. Oldham, Akron, Ohio ; part interest to each

[21] Appl. No.: 635,403

[22] Filed: Nov. 26, 1975

[51] Int. Cl.[2] ..... B02C 18/36

[52] U.S. Cl. ..... 241/82.5

[58] Field of Search ..... 241/82.1, 82.2, 82.4, 241/82.5, 82.6, 82.7

[56] References Cited

U.S. PATENT DOCUMENTS

| | | | |
|---|---|---|---|
| 473,049 | 4/1892 | Zies | 241/82.5 |
| 2,299,093 | 10/1942 | Kaptaller | 241/82.5 |
| 2,914,103 | 11/1959 | Ferris | 241/82.5 |
| 3,417,800 | 12/1968 | Tipton | 241/82.5 |
| 3,563,291 | 2/1971 | Anderson | 241/82.5 |
| 3,646,979 | 3/1972 | Anderson | 241/82.5 |
| 3,734,148 | 5/1973 | McCulty | 241/82.1 |
| 3,847,360 | 11/1974 | Seydelmann | 241/82.5 |

*Primary Examiner*—Granville Y. Custer, Jr.
*Attorney, Agent, or Firm*—Oldham & Oldham

[57] ABSTRACT

A meat cutting or grinding device including a frame in which an extruding means is provided for forcing meat along the axis of the extruder, a cutter means is provided for cutting the meat into pieces as it is being discharged, and the device includes an apertured extrusion plate perpendicular to the axis of the extruding means and made from low friction material, which discharge plate is positioned in a second discharge or carrier plate for reinforcing and supporting the low friction discharge plate in the cutting device, whereby the device will stand high extrusion and compression pressures. Specially shaped cutter blades are present in the cutter and grinding device.

9 Claims, 17 Drawing Figures

LOW FRICTION MEAT EXTRUDER AND CUTTER MEANS THEREFOR

This invention relates to meat cutting or grinding devices and especially to members having an apertured discharge disc therein with a cutter and extruder means forcing the meat or other processed material toward the disc and where the cutter usually is in pressure contact with the discharge disc.

Heretofore there have been many different types of meat cutting devices provided and primarily they have comprised a simple extruder member having a metal extrusion disc provided with a plurality of cylindrical shaped apertures therein for extruding the meat therethrough and cutting it into chunks by the associated cutter knife. This prior extruder device is of the type wherein quite high compressive pressures are set up in the extruder mechanism and the extruder screw provides high forces on the processed materials but, by having such high pressures, relatively rapid processing of the meat is obtained. These conventional types of meat grinders or extruders, as have been used for many years, require frequent sharpening of the cutter knives and the cutter plates and they also have limitations on how long the extruder can be used at one time without overheating.

It is the general object of the present invention to provide a noval and improved meat cutting or grinding device wherein the device can be operated without generating a large amount of heat.

Another object of the invention is to provide an improved meat grinder wherein the meat is cut or ground under low temperature conditions and is severed by a razor type knife used in the extruder.

Another object of the invention is to provide a sturdy, improved meat grinder having a special discharge assembly therein including a plastic extrusion disc and a backup metal disc and support means for the extrusion disc.

Another object of the invention is to improve the service life of meat cutter and extruding devices and to provide a meat extruder wherein the cutter knife operates against a low friction plastic material which does not rapidly dull the knife or heat up the cutter and extrusion means. Yet another object of the invention is to provide a combination cutter plate and knife assembly adapted to provide improved operating results in commercial meat market extruder or hamburger forming machines, and to provide an offset leading edge on a cutter blade to aid in meat processing.

The foregoing and other objects and advantages of the invention will be made more apparent as the specification proceeds.

When referring to corresponding members shown in the specification and referred to in the drawings, corresponding numerals are used to facilitate comparison therebetween.

Figure 1:
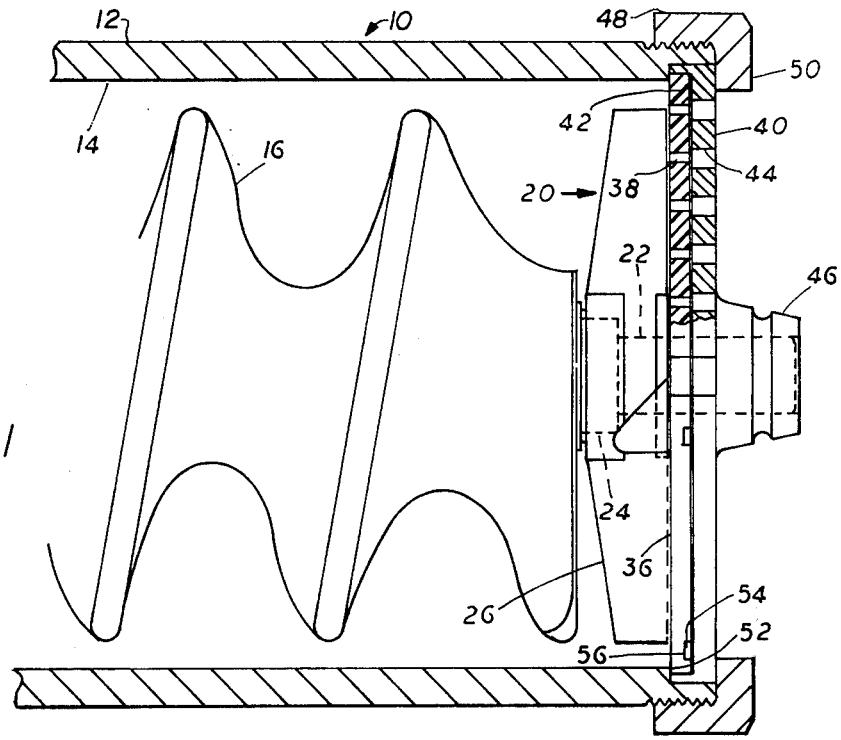
FIG. 1 is a fragmentary vertical section through a meat grinder or extrusion member embodying the principles of the invention.
Figure 2:
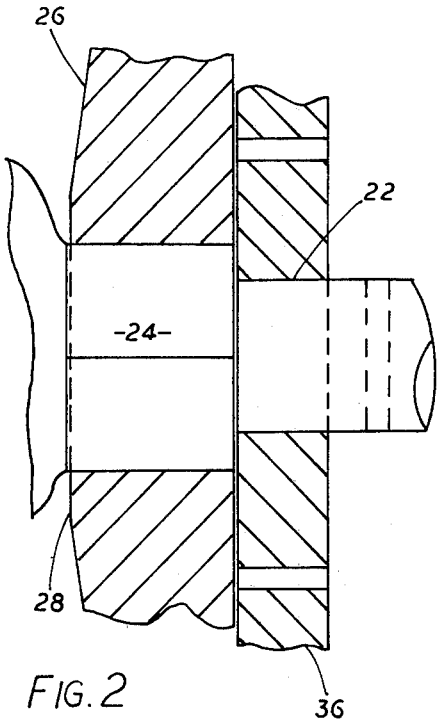
FIG. 2 is an enlarged section of a cutter blade and associated means in the apparatus of FIG. 1.
Figure 4:
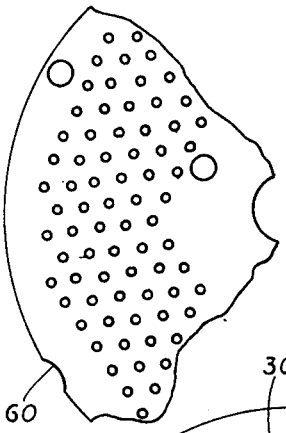
FIG. 4 is a fragmentary elevation of the plastic cutter disc of FIG. 1.

With reference to the details of the structure shown in the drawings, a meat cutting or grinding device is indicated as a whole by the numeral 10. The device is of substantially conventional construction insofar as it includes a metal frame 12 having any desired type of a support provided therefor and which frame 12 has a tubular portion defininng a cylindrical extrusion chamber 14. A rotatable extrusion or forcing means in the form of a conventional extrusion screw 16 is provided and it is positioned in the chamber 14 on the longitudinal axis thereof to substantially fill the same. This screw has a manual power crank or handle or a drive member connected thereto for rotating the screw and forcing meat received in the chamber 14 axially thereof. This meat is fed into the chamber 14 through a conventional hopper (not shown) operatively connecting thereto. At the discharge end of the chamber 14, a cutter member 20 is suitably operably secured to a shaft 22 of this screw 16 for rotation with the screw and shaft.

To secure good engagement of the cutter or knife 20 with the shaft 22 of the extrusion screw 16, normally a square shoulder 24 is formed on the extrusion screw at the end thereof where the mounting shaft 22 of the screw is formed and protrudes for use in positioning the screw operatively. The cutter 20 has a complementary shaped square aperture formed in one end thereof for engaging the shoulder 24 to have the cutter securely carried by the extrusion screw for rotation the rewith. This cutter 20 has a plurality of knives, arms or blades 26 extending from a hub portion 28 of the cutter means. These blades 26 each have a substantially razor sharp leading edge 30 formed thereon and extending the operative length thereof. To aid in providing operative clearance for the individual blades 26 as they are rotated for cutting action, normally the trailing portion 32 of the flat face surface 34 provided on each of the blades 26 angles slightly back or is relieved as indicated in the drawings.

In positioning the cutter 20 in the apparatus, normally the surfaces 34 of the individual blades of the cutter member are flush against an associated cutter disc 36. This disc 36 is made from a lower friction plastic material, such as nylon or other equivalent plastic that is relatively rigid and has the low friction properties. The disc 36 has a plurality of cutting apertures or bores 38 extending therethrough so as to facilitate cutting and discharge of the meat being forced through the meat cutting and grinding device of the invention. These bores 38, in association with the cutting edges 30 of the driven blades 26, provide a good, low friction cutting action on the meat being processed.

Retention of the plastic cutter disc 36 in the apparatus is facilitated by the provision of a metal carrier disc 40. This carrier disc 40 has a recess 42 in one face surface thereof in which the plastic disc 36 in received. The carrier disc 40 also has axially extending bores 44 formed therein with such bores being aligned with the bores or holes 38, but which are slightly larger in diameter than the bores 38 for flow of the cut meat therethrough as it is discharged from the apparatus 10.

The plastic disc 36 and the carrier disc 40 both have center bores formed therein through which the shaft 22 extends to the downstream face of the carrier disc 40. A suitable cap 46 or other conventional means may engage an end portion of this shaft 22 to aid in positioning the screw.

The carrier disc 40 is secured in position in engagement with the tubular frame of the apparatus, as by a lock ring 48. This lock ring 48 has a radially inwardly extending edge flange 50 that engages the periphery of the metal carrier disc 40 and forces it axially of the tubular frame 12. When the lock ring 46 is tightened, usually the carrier disc 40 seats against a shoulder 52 provided in the frame 12 at the end thereof. The plastic disc 36 also may engage this shoulder 52 and it is snugly held in the recess 42 when the lock ring 48 is tightened.

In order to avoid rotation of the plastic disc 36 with relation to the carrier disc 40, there are a plurality of circumferentially spaced studs 54 provided on and protruding from the recess 42 for seating in holes 56 provided in one face of the disc 36 and only extending partially therethrough.

In assembling the lock ring 46, the construction and arrangement of the apparatus of the invention is such that normally this lock ring can be manually tightened with the aid of an elongate lock wrench of lever arm which engages the lock ring as is conventional in this extrusion device. The relationship of the parts is such that normally the blades 26 of the cutter member will be positioned flush against the plastic disc 36 and the cutter 20 is pushed against an end of the screw to rotate the blades 26 with the extrusion screw. Cutting action is obtained on the portions of the meat being forced towards but not yet entering the bores 38 of the plastic disc 36 whereby an effective cutting action is obtained under the low friction contact of the blades on the plastic disc.

The apparatus of the invention avoids any pressurized metal to metal rotating contact or metal to metal cutting action. Hence, the razor cutting edges 30 on the blades 26 are not dulled rapidly in use, the meat being processed is not overheated, and the plastic disc 36 is not heated to any elevated temperature by even relatively extended use of the apparatus of the invention. The meat in process thus is not heated to anything appreciably above ambient temperatures and the shelf life of the product is improved in relation to the shelf life of meat that has been processed by prior types of similar apparatus wherein a metal to metal rotating contact exits, appreciable amounts of heat are generated, and the meat is raised to an elevated temperature while it is being processed, extruded and cut.

The apparatus of the invention is relatively simple to use, and it can be provided in form for use on existing meat extruding equipment by just replacement of the cutter member and the conventional cutter disc in existing equipment with the novel and improved cutter means and extrusion discs of the invention. Hence, the diameter and depth of the extrusion plate assembly of the invention would be equivalent to that in existing structures, preferably, to facilitate this convenient replacement of existing meat extrusion devices with the improved structures of the invention to obtain improved meat extrusion actions.

The plastic disc 36 usually has a plurality of circumferentially spaced peripheral recesses 60 therein to engage lugs (not shown) on the recess wall of the carrier disc 40 to aid in forming a unit therewith.

The structure shown can have any number of interlocking studs and recesses formed in the adjacent faces of the discs 40 and 36. Also the disc 40 may just be a flat disc that would be aligned and interlocked with the plastic disc as shown and have the ring 48 force the discs 40 and 36 together and the plastic disc 36 towards the shoulder 52. In any embodiment of the invention, the disc 36 usually is forced against the blades 26. But the axial compression of the disc against the blades may be limited by one of the discs seating against the shoulder 52. In such position, the cutter members 20 and blades 26 are in pressure contact with the plastic disc 36 or possibly spaced a few thousandths of an inch therefrom.

Figure 5:
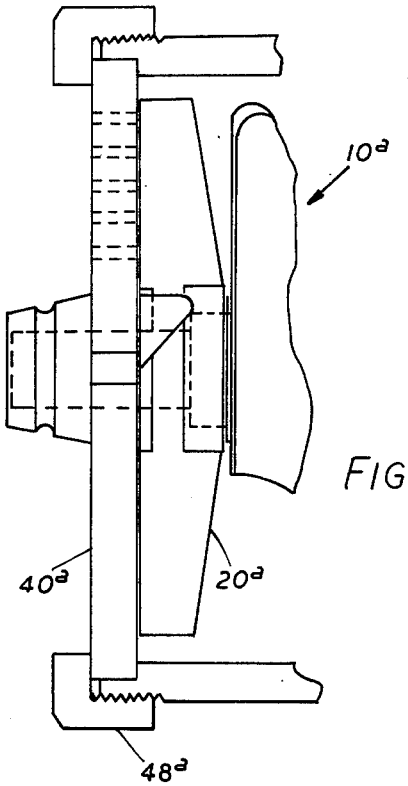
FIG. 5 is a fragmentary section through a modified extrusion member and plate of the invention.
Figure 7:
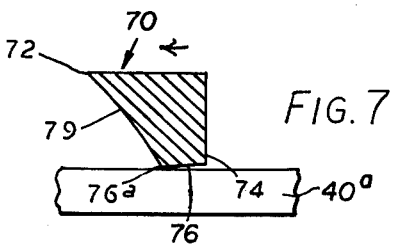
Figure 8:
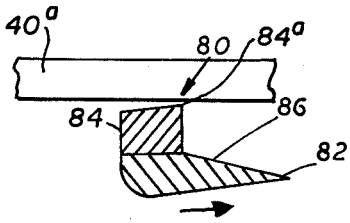

In FIG. 5 of the drawings, a cutter blade **20*a* is shown that is associated with an apertured metal cutter disc 40*a*. These members are held in engagement with an extrusion and meat shredding and cutting device 10*a* by a suitable lock ring 48*a*. It should be realized that the lock ring 48 in FIG. 1 or the lock ring 48*a* in FIG. 5 can be free for extra axial compression movement when tightened to engage the cutter disc and screw 16. The cutter means 20*a* is shown, FIG. 5, as having blades 26 as in FIG. 3 and it has solid arms 26 with cutting edges 30 thereon that can be sharpened as wear occurs for improved functioning. However, rather than the type of an arm shown on the cutter 20*a*, the arms 70 or 80, as shown in FIGS. 7 and 8, are especially adapted to be used in the metal-to-metal relationship of the cutter unit and metal extrusion disc shown in FIG. 5. The arm 70 has a modified overhanging L-shaped section terminating in a leading sharpened edge 72 which is offset axially from the plate 40*a*. The arm includes a base section 74 that has a sharpened cutting edge 76*a* which preferably is relieved at any desired acute angle to provide clearance towards the trailing edge of the blade by the surface 76. By this overhanging leading cutting edge portion 72, the meat can be sliced preparatory to the final extrusion action and the forcing of the meat through the cutter disc. The arms 70 preferably are made from a high speed tool steel and will have a long service life. If desired, a separate cutting bar can be brazed to the bottom of the arm 70. An overhanging tapered or flatly arcuate edge 79 is provided on the cutter blade to extend axially inwardly toward the cutter edge of the blade and towards the cutter disc to aid in forcing meat toward the disc 40*a*** for final cutting and extrusion.

The cutter arm of blade 80 shown in FIG. 8 is similar to the cutter 70 and it has a leading knife edge 82 that connects to a hardened cutter base section 84 by a tapered edge 86. The base section 84 is suitably secured to the remainder of the arm 80 and a similar hardened insert can be provided at the leading edge **76*a* of the arm 70 of FIG. 7 and blend into the contour shown therefor. The surface 86 of FIG. 8 can blend more directly into the cutting edge 84*a* of the arm by making the base section 84 protrude less from the arm or by having the surface 86 extend axially downstream at a greater angle than that shown, or by having the surface 86 be shaped like and blend into the arm as the surface 79 of FIG. 7** to avoid sharp corners that might trap material thereagainst.

Figure 9:
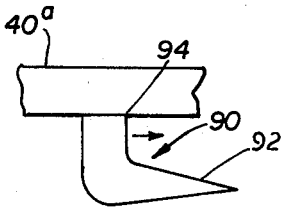
Figure 10:
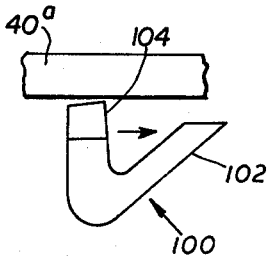

The cutter blades shown in FIGS. 9 and 10 of the drawings are primarily adapted for use with plastic cutter disc 36 of FIGS. 1. Thus, in this instance, a generally L-shaped member 90 is shown that has a cutter portion or section 92 as the forward edge of this cutter blade and with the cutter portion 92 terminating axially offset from an associated cutter disc, while a slightly tapered, flat sharp cutter edge 94 is provided on the portion of this cutter arm or blade that is pressed against the associated extrusion disc. The cutter knife 100 of FIG. 10 has a leading edge 102 that extends forwardly and axially inwardly of the cutter knife but terminate axially spaced and remote from a base cutting section 104 of the cutter knife that would be pressed against the associated cutter disc or plate. These blades 90 and 100 usually are about twice as wide as a regulation blade and provide an improved cutting action and a long cutter blade life with a minimum of sharpening thereon.

It should be realized that the various cutting blades provided in the apparatus of the invention can be relatively massive in size to provide improved strength therefor. The sectional views shown in FIGS. 6 through 10 are taken near the ends of the blades where they have gradually tapered to reduced cross sectional area in relation to the base and larger portions of these individual blades where they are secured together at a hub portion of the knife or cutter means.

Figure 6:
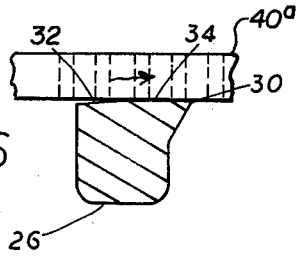
FIGS. 6 through 10 are vertical sections through arms or blades of different shapes of cutter members used in the extrusion devices shown in FIGS. 1 and 5.
Figure 11:
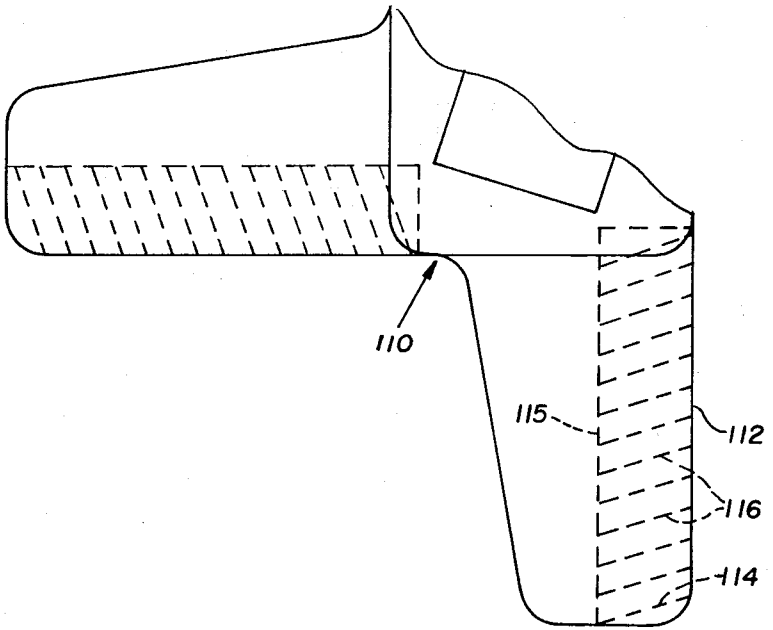
FIG. 11 is a plan view of a modified cutter knife of the invention.

A modified cutter blade 110 is shown in FIG. 11 and it is preferably of the general cross sectional shape as shown for the blade of FIG. 6. However, in this instance, a substantially flat surface 112 is formed on the bottom portion of this blade and it has a plurality of diagonally extending recesses 114 formed therein in parallel relationship to each other. In this embodiment of the invention, the recesses or slots 114 are shown extending into the cutter blade about ⅛ inch. The recesses are provided at an angle of about 20° to the straight line forming the front or leading edge 115 of this cutter knife 110. It should be noted that cutting sections or edges 116 are provided on the surface 112 at each recess and they extend radially of the blade a sufficient distance as to operatively overlap, substantially, the adjacent recess and the adjacent cutting edge whereby a plurality of cutting surfaces are provided on this blade. Normally the edge 115 of the blade is sharp. By the plurality of individual cutting and slicing actions provided by the plurality of cutting surfaces on the blade 110, an effective tearing, shredding and slicing action is provided on the meat for effective cutting and extrusion thereof.

The individual blades on the cutter 110 have inwardly slanted or beveled flat surfaces 118 thereon to aid in forcing meat towards the outer plate, and in cutting the meat.

Figure 3:
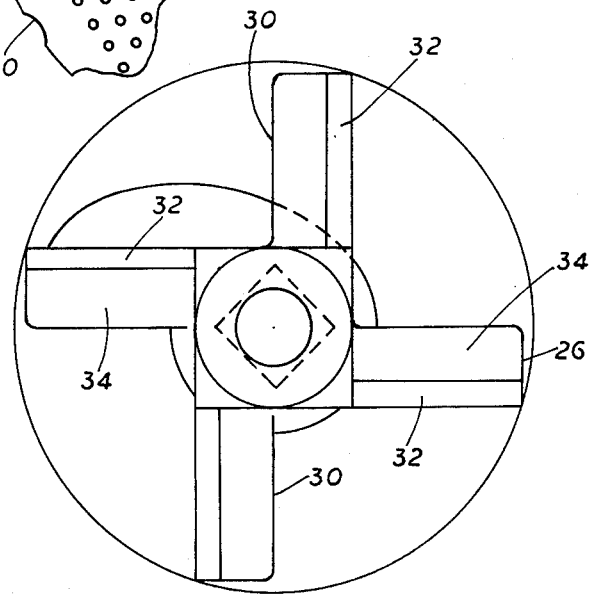
FIG. 3 is an end elevation of the extrusion screw and cutter blade of the invention.

The cutter blade of FIGS. 3 and 6 is quite strong and it can be made as a unitary casting having blades or arms of greater circumferential length at their ends than the blade's axial thickness. But the blades are axially as thick as they are long in circumferential length where they blend into the blade hub area. The flat inclined surfaces on the blade arms as at 79, FIG. 7, extend from the sharp leading edge 72 of the blade towards the cutter means or disc with which they are used.

Any cutter blade or knife can be used with either the construction of FIG. 1 or with the apertured metal disc **40*a* or 40*b*** of the apparatus described hereinafter.

Figure 14:
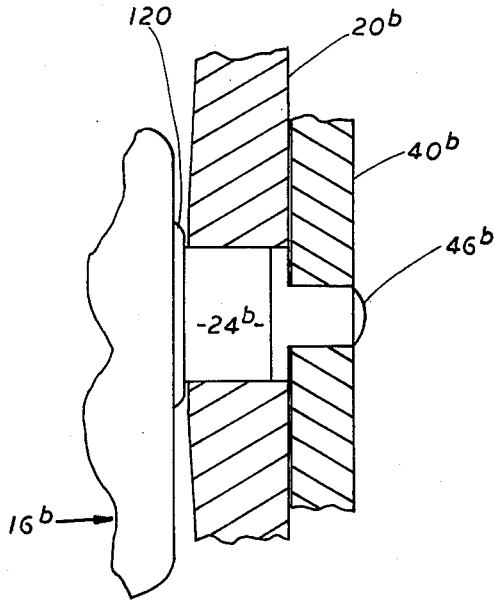
FIG. 14 shows a section of a modified assembly of a cutter blade and extrusion disc of the invention.
Figure 15:
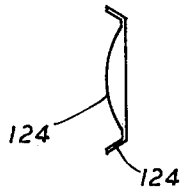
FIG. 15 is a side elevation of a spring member used in the assembly of FIG. 14.
Figure 16:
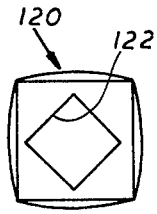
FIG. 16 is a plan view of the spring member or washer of FIG. 15.

Reference now is made to the details of the structure shown in FIG. 14, and thus an extrusion screw **16*b* is shown that has a square end shoulder 24*b* positioning a cutter blade 20*b* thereon. An extrusion disc 40*b* is held in firm engagement with the cutter blade by a lock ring like the rings 48, 48*a*. The disc 40*b* supports a screw end 46*b*. In this embodiment of the invention, some resiliency is provided in the frictional contact between the cutter blade 20*b* and the extrusion disc 40*b* by the presence of a metal spring or washer 120 positioned between the end of the extrusion screw 16*b* and an associated flat surface of the cutter blade 20*b*. This particular spring washer 120 has a flat center section with an aperture 122 therein for engaging the square shoulder on the extrusion screw and being affixed thereto. Outwardly inclined edge flanges 124 are provided around the periphery of the spring washer and these inclined edges 124** are flattened in the pressurized assembly of the apparatus of the invention whereby resiliency is provided in the mounting of the cutter blade but yet it is effectively and tightly pressed against the extrusion disc whereby an improved cutting action is obtained.

The spring metal washer 120 or a resilient plastic disc, as one made from polyurethane, can be used in any embodiment of the invention to provide a resilient pressure on the cutting blade-disc assembly.

Figure 12:
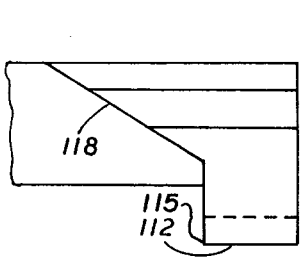
FIG. 12 is a side elevation of the cutter knife of FIG. 11.
Figure 13:
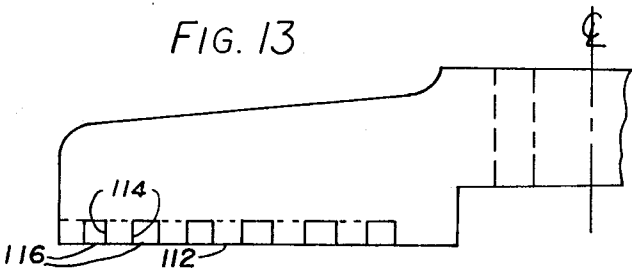
FIG. 13 is a side elevation of one cutter blade of the knife of FIG. 12.

The apparatus of the invention has been tested in use and a very good cutting action has been obtained on meat and minimal service of the cutting blades or plates has been required. Particularly good results were obtained when apparatus such as the assembly shown in FIG. 14 is used with a metal extrusion plate and/or where the cutter knife is of the particular construction shown in FIGS. 6 and 7 of the drawing. Also, such types of cutter blades or means, of FIGS. 6, 7 and 12, can be effectively used with plastic extrusion discs as shown in FIG. 1 of the drawings.

It is important in use of the invention that the cutter knife be effectively pressed against or be immediately adjacent the associated cutter disc. Thus, the cutting and extruding action will be improved by the apparatus of the invention, a minimum of wear of the cutter knife and extrusion disc is produced and improved meat extruding actions are obtained with a minimum or no maintenance on the apparatus of the invention. Use of the beveled or slanted leading edges of the cutter blades, as in FIGS. 7 and 12, reduces the pressure of the blades on the cutter discs but improves the meat cutting and extrusion action. The cutter blades of the cutter means may extend radially or they may be offset from the rotary axis to be chordally positioned at the margins of the square hub part of the cutter.

The extrusion discs 40, or **40*b*, etc. are all apertured and are pressed against the cutter knives or blades by the rings 48, or 48*a*. Hence, the discs 36 or 40*a*, when operative, may not seat against a shoulder on the housing 12 but usually they do seat in such manner. The other components of the apparatus are so sized as to provide pressure on the cutter knife to press it against the extrusion disc in the assembly. The metal washer 120 or equivalent provides some spring in the axial pressure forcing the cutter blade against its associated extrusion disc 40*b***.

Figure 17:
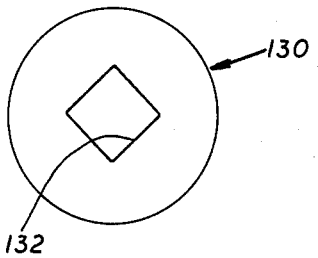
FIG. 17 is a plan view of a plastic washer.

Referring to FIG. 17, a plastic disc of uniform thickness is indicated by the numeral 130 and it has a square shaped hole 132 therein for engaging with the square section of the extruder means or screw 10 as shown in the drawing. Such plastic discs may, for example, be usually less than ⅛ inch thick and they are relatively tough. This disc preferably is made from polyurethane plastic and it has some slight compressibility or resilience, such as being from about 75 to about 95 durometer on the Shore A scale. The disc might be, for example, from about 0.060 to 0.125 inch thick and it would compress slightly when pulled into tight operative compressive engagement with the associated extrusion parts. The disc would be used in lieu of the metal spring 120, and one effective disc was about 0.080 inch thick and had a durometer of 95.

It should be noted that the cutter blades shown in FIGS. 6, 8, 9 and 10 are reversed, as shown, as they normally are rotated clockwise and the cutting edges and operative portions thereof are clearly shown in the drawings. It further should be noted that the cutter knife 70, as shown in FIG. 7, has a self sharpening action on the surface 76 and the leading edge **76*a*** thereof when pressed against a metal cutter disc.

It also will be realized that the cutter blade 90 as shown is preferably from a one piece cutter and it has the overhanging leading edge 92 thereon and a sharp cutting edge 94 to aid in providing an effective cutting action.

It also should be understood that the extrusion screw means 16 as shown in the drawings has suitable members journalling or supporting the end of such extrusion screw device remote from the cutter disc means 36 and 40 whereby such extrusion screw will not move axially away from the cutter disc. Hence, the amount of pressure applied to the extrusion disc by tightening the lock ring 48 can be varied to force the discs 40 and 36 against the cutter knife to provide an axial compressive force on these associated members. By use of a spring member, as shown in FIGS. 14–17, resilient pressure can be provided on the assembled cutter knife to force it against the cutter disc. This may space the cutter edges **76*a* or 94**, etc. on the cutter blades away from the cutter disc one or two thousandths of an inch, and again, cut down on the wear on the cutter blade and cutter disc but provide an effective good cutting action.

A feature of the cutter of FIG. 6 is that its cutter arms are substantially square in section and are tapered downwardly in radial thickness from their bases to their free ends, the section of FIG. 6 being taken at the base end of the cutter arm.

Slanting the overhanging leading edge of the cutter blades axially inwardly as shown in FIGS. 7, 8, 9 and 12, aids in obtaining improved cutting action and a lengthened service life. Hence, such new and improved blades can be used in the assemblies of FIGS. 1, 5 or 14. The blade surface 79, 86, 92 or 118 can extend axially at angles of from about 15° to 20° up to about 50° to 60°. Very good cutting and extrusion action has been obtained when the overhanging leading edge is of tapered shape and is wider at its base portion than at its free end. At the base portion of the blade, in one example, the overhanging surface had a width (length) of about ⅝ inch and at its free end about 5/16 inch. The surface was at an angle of about 49° with the face of the extrusion disc. Cutter knives with overhanging slanted leading edges have given excellent service lives with no maintenance and they can be used with metal or plastic extrusion discs.

While several complete embodiments of the invention have been disclosed herein, it will be appreciated that modification of these particular embodiments of the invention may be resorted to without departing from the scope of the invention.

I claim:

1. In a meat cutting and/or extrusion device including a frame having a tubular portion in which a screw extruding means is positioned for forcing meat along the axis of such frame portion, the combination of an operative apertured discharge means carried by said frame at an end thereof and positioned normal to said axis, a rotatable cutter means secured to and rotating with said extruding means immediately adjacent said discharge means for cutting the meat into pieces, said discharge means comprising an apertured metal reenforcing disc and an apertured low friction plastic cutter disc positioned adjacent said cutter means and being parallel to said metal disc, the apertures in said metal and plastic discs being aligned, and means securing said discharge means to said frame.

2. In a meat cutting and/or extruding device as in claim 1 where said cutter means includes a plurality of cutting arms and a hub portion and with the cutting arms having an overhanging leading edge connected to a cutting edge of the cutting arms by an inclined surface.

3. In a meat cutting and/or extruding device as in claim 1 where said discs are positioned in fixed axially aligned relation.

4. In a meat cutting and/or extruding device as in claim 1, the provision of a means providing resilient axial pressure of said cutter means against said plastic cutter disc.

5. A meat cutting and/or extruding device including an apertured flat faced discharge means and a cutter means characterized by said cutter means including a cutter knife having a plurality of cutter blades each having an overhanging leading edge axially spaced from said face of said discharge means, a cutting edge adjacent said discharge means, and a flatly arcuate surface connecting said leading edge to said cutting edge.

6. In a meat cutting and/or extruding deivce as in claim 5 where said flatly arcuate surface is a flat inclined surface that is formed on each of said cutter blades.

7. A meat cutting and/or extruding device including an apertured flat faced discharge means and a cutter means characterized by said cutter means including a cutter knife having a plurality of cutter blades each having an overhanging leading edge axially spaced from said face of said discharge means and a cutting edge adjacent said discharge means, said cutter blades each have a relatively flat inclined surface thereon extending from said leading edge to said cutting edge, which inclined surface forces meat towards said discharge means on rotation of said cutter means.

8. In a meat cutting and/or extruding device as in claim 7 where said relatively flat surface thereon is flatly arcuate with the arc of the surface extending slightly into its said cutter blade.

9. In a meat cutting and/or extrusion device including a tubular frame in which a screw extruding means is provided for forcing meat along the axis of such means, the combination of an operative apertured discharge means carried by said frame at an end thereof and positioned normal to said axis, and said cutter means includes a cutter knife having a plurality of cutter blades each having a flat surface formed on the blades adjacent said discharge means, said flat surfaces having a plurality of spaced parallel recesses formed therein extending diagonally the width of the blade and a cutting edge is formed at one margin of each recess.

* * * * *

UNITED STATES PATENT OFFICE

CERTIFICATE OF CORRECTION

PATENT NO. : 4,036,442

DATED : July 19, 1977

INVENTOR(S) : J Haywood Barnes

It is certified that error appears in the above-identified patent and that said Letters Patent are hereby corrected as shown below:

Column 2, line 24, change "defininng" to --defining--.

Column 2, line 45, change "rewith" to --therewith--.

Column 3, line 35, change second use of the word "of" to --or--.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*